United States Patent [19]

Wund

[11] Patent Number: 4,907,793

[45] Date of Patent: Mar. 13, 1990

[54] ARRANGEMENT ALLOWING VARIED USE OF A SURFACE THAT IS PROVIDED WITH A COVERING OF GRASS OR THE LIKE

[76] Inventor: Josef Wund, Ifenstrasse 12, D 7990 Friedrichshafen, Fed. Rep. of Germany

[21] Appl. No.: 331,614

[22] Filed: Mar. 30, 1989

[30] Foreign Application Priority Data

Mar. 30, 1988 [DE] Fed. Rep. of Germany ..... 3810818

[51] Int. Cl.[4] ..... E04H 3/10

[52] U.S. Cl. ..... 272/3; 52/6; 273/DIG. 13; 47/17

[58] Field of Search ..... 52/6, 28, 126.5, 126.6; 272/3; 47/17; 273/195 A, DIG. 13; 404/71

[56] References Cited

U.S. PATENT DOCUMENTS

| | | | |
|---|---|---|---|
| 3,258,884 | 7/1966 | Wenger | 52/6 |
| 3,266,800 | 8/1966 | Yee | 272/3 |
| 3,433,137 | 3/1969 | Henderson | 272/3 |
| 3,531,898 | 10/1970 | Facemire | 52/6 |
| 3,951,406 | 4/1976 | Rock | 272/3 X |
| 3,968,606 | 7/1976 | Facemire | 52/6 X |
| 4,312,504 | 1/1982 | Rutledge et al. | 272/3 |
| 4,638,604 | 1/1987 | Rogers et al. | 52/6 |

*Primary Examiner*—Richard E. Chilcot, Jr.
*Attorney, Agent, or Firm*—Robert W. Becker & Associates

[57] ABSTRACT

In order to provide versatile use for a surface that is provided with a covering of grass or the like, a plurality of bases are inserted in the subsoil of the surface below the grass covering for the support of a supporting structure that is provided with a floor covering that can be walked or driven upon. When the grass covering is used, the bases are covered by inserts that are adapted to be placed in the grass covering. When the surface is to be used for a different purpose, the supporting structure is supported on the bases in such a way as to be spaced from the grass covering. Illuminating means that are mounted on the supporting structure and that produce effects for photo-biological processes are provided for irradiating the grass covering, so that despite the covering, growth is not inhibited. Thus, the surface has a versatile use without having to worry about damage to the grass covering. Conversion is effected in a short period of time in an economical manner.

18 Claims, 6 Drawing Sheets

ARRANGEMENT ALLOWING VARIED USE OF A SURFACE THAT IS PROVIDED WITH A COVERING OF GRASS OR THE LIKE

BACKGROUND OF THE INVENTION

The present invention relates to an arrangement that allows varied use of a surface that is provided with a covering of grass or the like.

The usability of grass playing fields is very limited, because such fields are individually designed for a specific purpose, and a subsequent alteration of its use is generally, if not always, accompanied by considerable damage to the grass covering. Although it is known to cover a grass surface with sheeting or panels, for example in order to convert a football or soccer field into a surface that can be travelled upon, and to use this surface for concerts or other performances, such a covering and load destroys the grass covering, which then sometimes cannot be used as a playing field for several weeks. In addition, considerable expense is involved in the conversion and in placing the grass covering in a usable state again.

It is therefore an object of the present invention to provide an arrangement that allows varied use of a surface that is provided with a covering of grass or the like, and that then makes it possible to utilize such a surface in a very versatile manner without the grass covering thereby being affected or even damaged. Furthermore, the conversion into a surface that can be walked or driven upon should be capable of being realized in a short period of time. In addition, the expense and complexity involved therewith should be kept low, so that a change of use can be undertaken many times without difficulty and an arrangement provided with such a surface can have a versatile use while also being economical.

BRIEF DESCRIPTION OF THE DRAWINGS

These and other objects and advantages of the present invention will appear more clearly from the following specification in conjunction with the accompanying schematic drawings in which.

SUMMARY OF THE INVENTION

Figure 1:
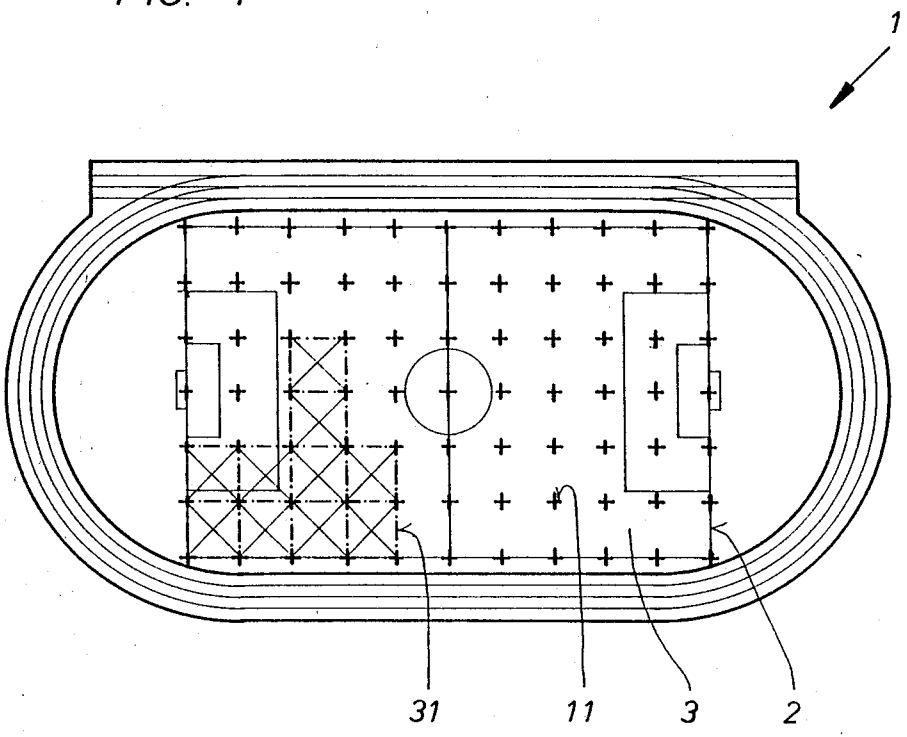
FIG. 1 is a plan view of a playing field of a stadium showing one exemplary embodiment of the inventive support elements that are disposed in a patterned manner in the subsoil.

The arrangement of the present invention, with which the aforementioned objects can be realized, is characterized primarily in that foundation or base means are inserted, preferably in a selectable patterned spacing relative to one another, in the subsoil of the surface, below the grass covering, for the support of a supporting structure, for example a surface-supporting structure, that is provided with a floor covering that can be walked or driven upon; when the grass covering is used, the base means are covered by insert means that are adapted to be placed in the grass covering, and when the surface is to be used for a different purpose, the supporting structure is supported on the base means in such a way as to be spaced from the grass covering, with illuminating means, which are preferably held on the supporting structure and that produce effects for photo-biological purposes, being provided for irradiating the grass covering.

It is very expedient for each of the free spaces of the grass covering that receive the insert means to be provided with a liner that either individually or together can be shifted vertically and that are disposed below the grass covering; these liners are preferably to be supported on the base means. The liners can be embodied as sleeves and/or support bases for the supporting structure, can be introducible into the free spaces, and can be acted upon by pressure medium. Each of the liners can be shifted in height within a selectable range via a servomechanism, for example in the form of an electric motor, an adjusting piston that is placed in a cylinder and is acted upon by pressure medium, etc.

In the region of the free spaces, holding or retaining means, for example in the form of a grid or wire insert, preferably of plastic, should be disposed in the grass covering. It is to be understood that the insert means could also be provided with such holding or retaining means in order to avoid damage to the grass that they hold due to ball players or the like.

The insert means of the free spaces of the grass covering are expediently embodied in the shape of planting pots that, in order to avoid damage, are preferably made of a resiliently deformable material, such as foam material, rubber, or the like. The insert means are supported on the liners, and can be removed by a special member, by compressed air, etc.

If a surface that is provided with a covering of grass or the like is equipped with an arrangement pursuant to the present invention, it is possible not only to use the grass covering in the intended manner, but also in a short period of time to provide this grass covering with a surface that can be walked or driven upon, so that it can be used in a different manner, for example for a fair, a concert, or some other performance. The conversion can be mechanically undertaken in a short period of time. In addition, material expenses are kept within limits, so that a very versatile usability can be achieved. The chief advantage of the inventive arrangement is that when the facility is used for a different purpose, the grass covering is not adversely affected or damaged. In fact, after removal of the supporting structure the grass can immediately again be played upon, since even when it is covered for a long period of time, the grass covering is not damaged. Therefore, a facility that has a surface that is provided with the inventive arrangement can be operated very economically.

Further specific features of the present invention will be described in detail subsequently.

DESCRIPTION OF PREFERRED EMBODIMENTS

Referring now to the drawings in detail, the stadium 1 illustrated in FIG. 1 is provided with a playing field 2, under the grass or turf covering 3 of which are disposed support elements 11 that are arranged in a pattern at a side-to-side distance from one another. With the aid of the support elements 11, it is possible in a fairly simple manner, as partially indicated by dot-dash lines in FIG. 1, to provide a supporting structure 31 for a floor-like covering that can be walked or driven upon over the playing surface 2, so that although the grass covering 3 is covered, it is not thereby damaged, and the surface 2 of the stadium 1 can therefore be used for another purpose.

Figure 2:
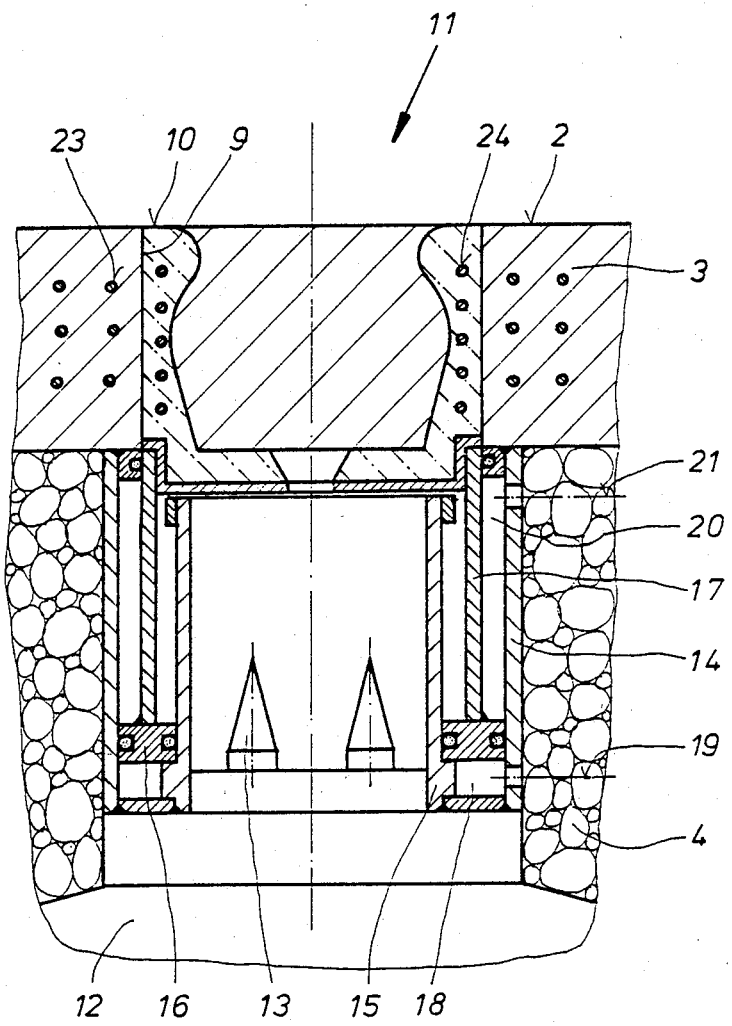
FIG. 2 is a cross-sectional view of one of the support elements of the arrangement of FIG. 1.
Figure 3:
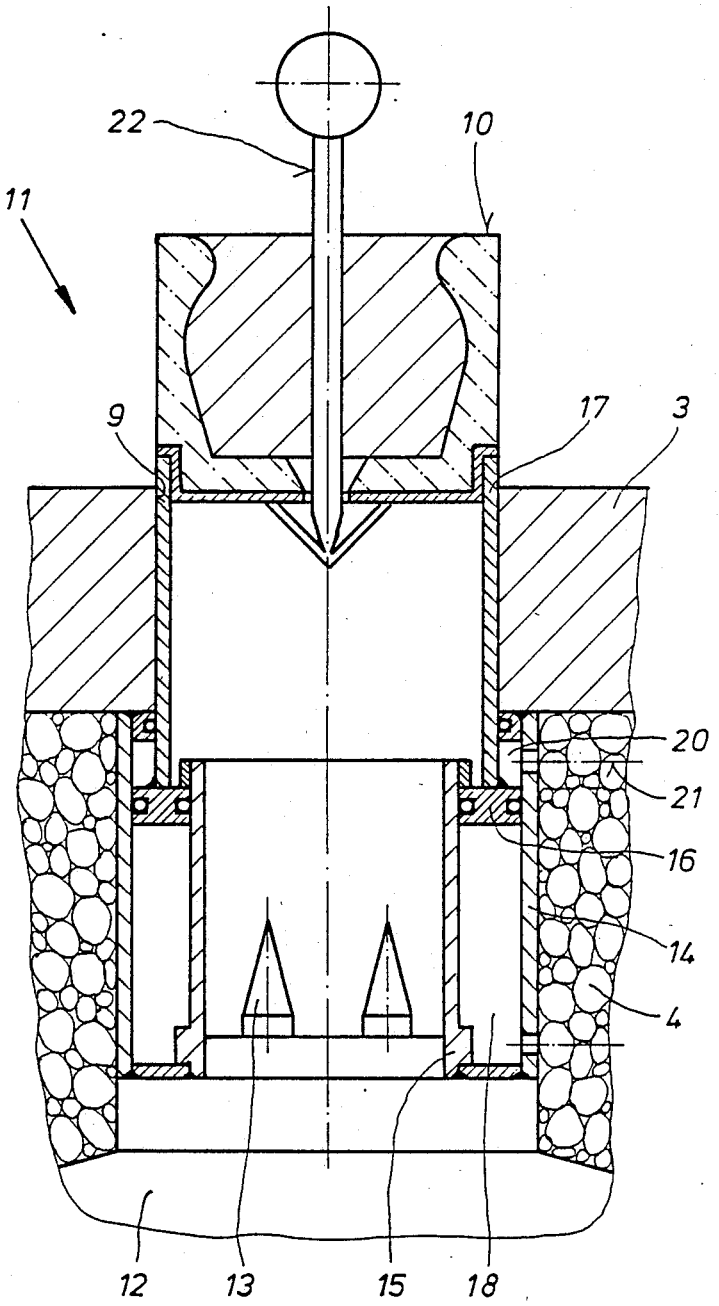
FIG. 3 is a cross-sectional view showing the support element of FIG. 2 in an operating position prior to installation of the supporting structure.
Figure 4:
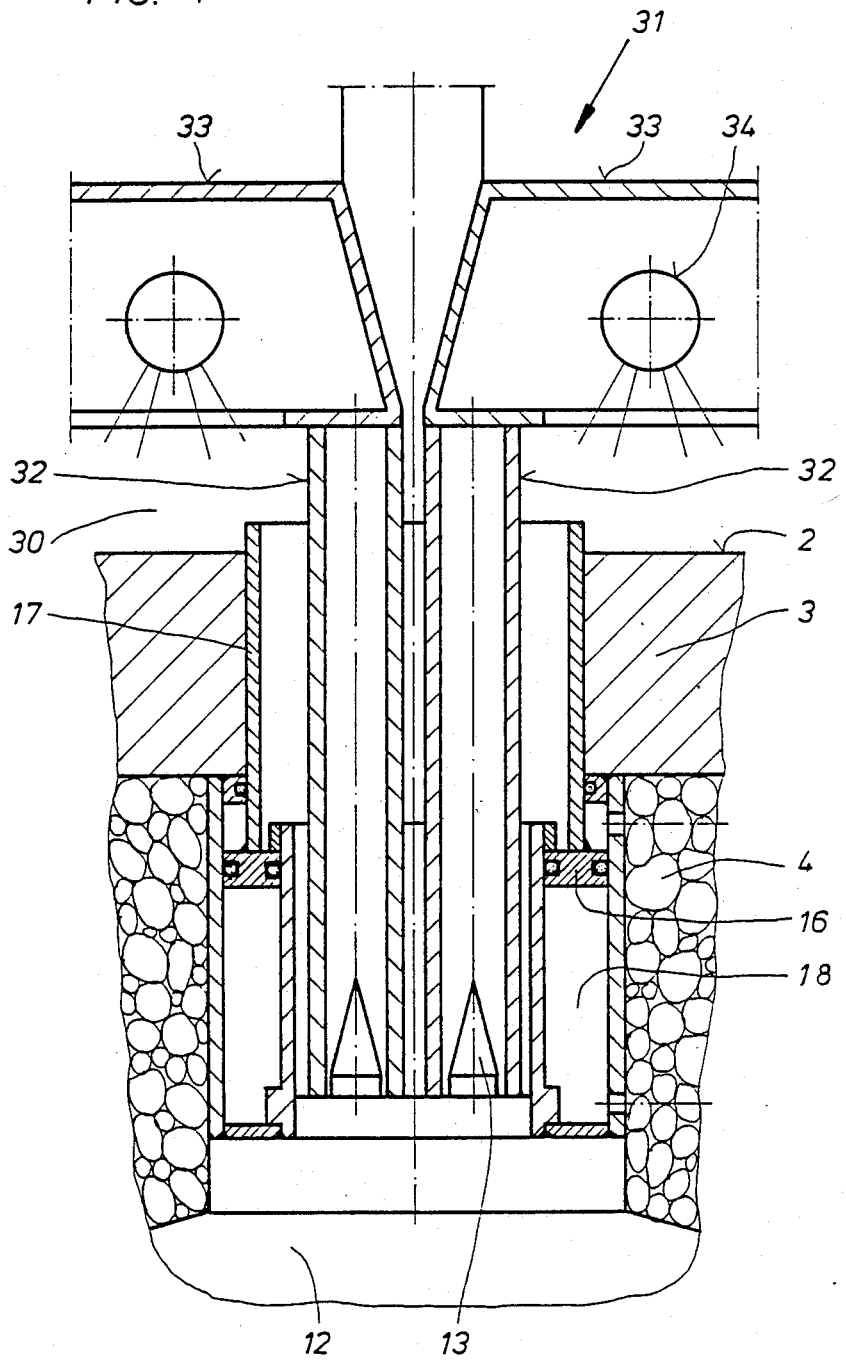
FIG. 4 is a cross-sectional view of the support element of FIG. 2 with a supporting structure placed thereupon.

As can be seen in the detailed views of FIGS. 2 to 4, each of the support elements 11 comprises a foundation or base 12 that is placed in the soil 4 of the surface 2 and that is provided with tholepins 13 to hold the support legs 32 (FIG. 4) of the supporting structure 31. In addition, supported on the base 12, concentric to one another, are two guide members 14 and 15 between which is placed a piston 16 to which can be supplied hydraulic fluid or other pressure medium; mounted on the piston 16 is a liner 17 that is embodied as a sleeve. Disposed on the liner 17 is a cover 10 in the shape of a planting pot via which a free space 9 of the grass covering 3 is closed off.

If, in order to undertake a conversion, pressure medium, for example compressed air, is supplied to the pressure space 18 that is associated with the piston 16 via a pressure medium line 19, the liner 17 is shifted into the free space 9 and the cover 10 is raised, as illustrated in FIG. 3. Then, either manually, for example with the aid of an insertable member 22, or mechanically, the cover 10 can be easily removed, thereby exposing the base 12. Now, as shown in FIG. 4, the support legs 32 of the supporting structure 31 are placed upon the individual bases 12, and the cross members 33 are installed.

The cross members 33 of the supporting structure 31 are spaced from the grass covering 3 of the field 2, so that an empty space 30 is provided; the grass covering 3 is thus aerated and is not damaged by the supporting structure 31. Furthermore, since mounted on the cross members 33 are regulatable lamps or other illuminating devices 34 that have effective spectra for photo-biological processes, and via which the grass covering 3 is to be irradiated, the individual plants of the grass covering 3 can continue to grow despite being covered, so that play can immediately be resumed upon the playing field or grass covering as soon as the supporting structure 31 is dismantled.

After the supporting structure 31 has been dismantled, it is merely necessary, in order to return the liner 17, which prevents the edges of the grass covering 3 from becoming damaged in the vicinity of the free space 9 and also prevents dirt from falling upon the base 12, to supply pressure medium to the pressure space 20 via the pressure medium line 21. The covers 10 are then placed into the free spaces 9 in order to close off the grass covering 3 of the playing field 2 and thereby prepare it for play.

So that during use the grass covering 3 cannot readily become damaged in the region of the free spaces 9 and/or the covers 10, it is advisable to provide in the grass covering 3 and the cover 10 (see FIG. 2) holding or retaining means 23 and 24 for example in the form of a grid or wire insert, that are preferably made of plastic.

Figure 6:
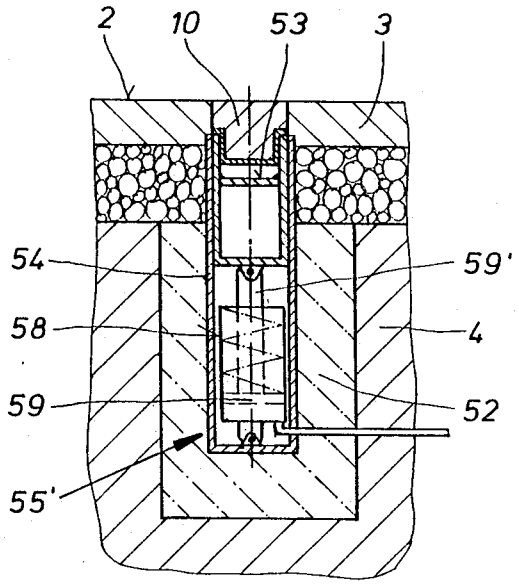
FIGS. 5 and 6 are cross-sectional views of further exemplary embodiments of the inventive support element.
Figure 5:
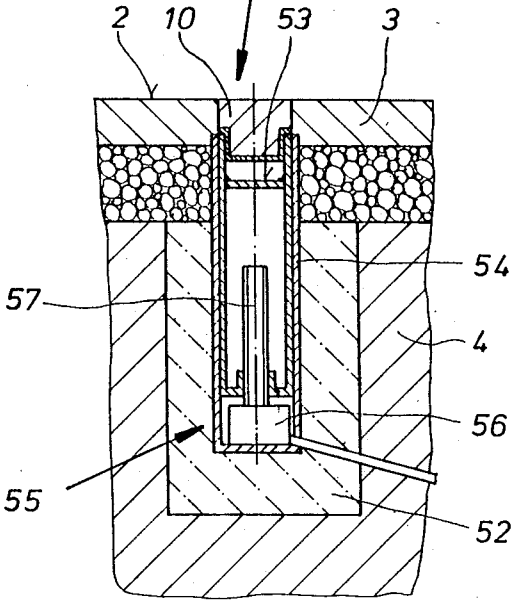
Figure 7:
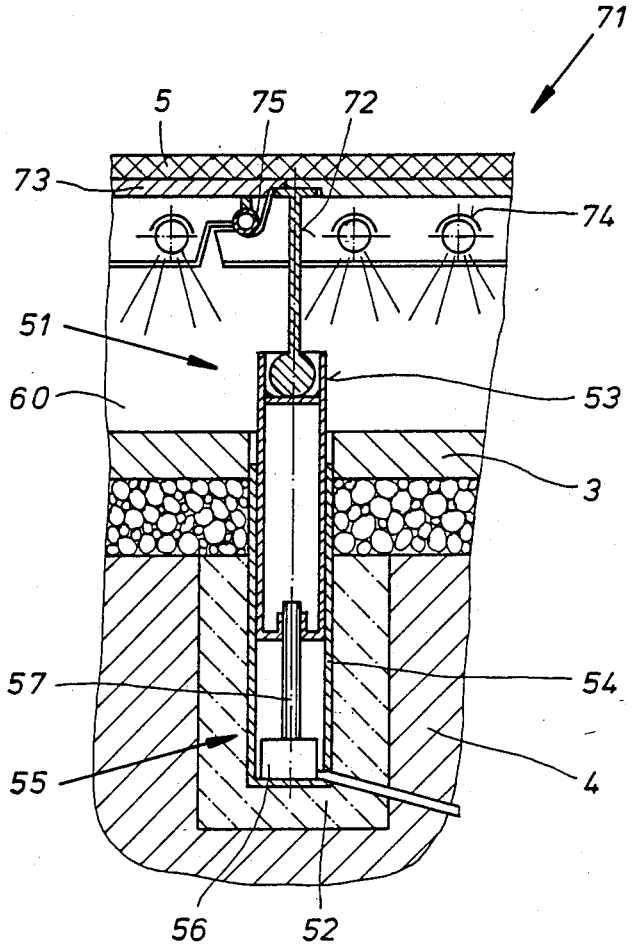
FIG. 7 is a cross-sectional view of the support element of FIG. 5 with a supporting structure placed thereupon.

In the embodiment of the support element 51 illustrated in FIGS. 5 to 7, foundations or bases 52 are inserted into the ground or soil 4 of the playing field 2; a respective guide member 54 is placed in each base 52. Disposed in each of the guide members 54 is a liner 53 that can be shifted in height via variously embodied servomechanisms 55 or 55', and that is embodied as a carrier for the support legs 72 of a supporting structure 71.

In the embodiment illustrated in FIG. 5, an electric motor 56 is provided as the servomechanism 55. By means of a threaded spindle 57, the electric motor 56 is operatively connected with the liner 53. In FIG. 6, the servomechanism 55' in contrast comprises a piston 59 that is disposed in a cylinder 5B and that can be acted upon by a pressure medium; the piston rod 59' of the piston 59 acts upon the liner 53.

The cross members 73 of the supporting structure 71 are connected to one another via adjustment elements 75 and are again disposed at a distance from the grass covering 3, so that an empty space 60 is provided. In addition, lamps or other illuminating devices 74 are mounted on the cross members 73, so that again light can be supplied to the plants of the grass covering 3. The growth of the plants of the grass covering 3 that is covered by the supporting structure 71, which in turn is provided with a floor covering that can be walked or driven upon, is thus not adversely affected, so that after removal of the supporting structure 71, the grass covering 3 can again immediately be played upon.

The present invention is, of course, in no way restricted to the specific disclosure of the specification and drawings, but also encompasses any modifications within the scope of the appended claims.

What I claim is:

1. An arrangement that allows varied use of a surface that has subsoil and is provided with a covering of grass or the like, said arrangement comprising:

a plurality of base means inserted in said subsoil of said surface, below said grass covering, for the support of a supporting structure that is provided with a floor covering that can be walked or driven upon; when said grass covering itself is to be used, said base means are covered by insert means that are adapted to be placed in said grass covering, and when said surface is to be used for a different purpose, said supporting structure is supported on said base means in such a way as to be spaced from said grass covering, with illuminating means, which produce effects for photo-biological processes, being provided for irradiating said grass covering when said supporting structure is in place.

2. An arrangement according to claim 1, in which said base means are inserted in said subsoil of said surface in a selectable patterned spacing relative to one another, in which said supporting structure is a surface-supporting structure, and in which said illuminating means are carried by said supporting structure.

3. An arrangement according to claim 1, in which said grass covering is provided with free spaces for receiving said insert means, with each of said free spaces being provided with a liner.

4. An arrangement according to claim 3, in which said liners are disposed at least partially below said grass covering when the same is being used, and which includes means for shifting said liners in a vertical direction.

5. An arrangement according to claim 4, in which said liners are supported on said base means.

6. An arrangement according to claim 4, in which said liners are embodied as sleeves, and said means for shifting said liners includes a piston that operates with a pressure medium.

7. An arrangement according to claim 4, in which said liners are embodied as support bases for said supporting structure.

8. An arrangement according to claim 7, in which said support base liners are each provided with a servomechanism as said means for shifting same within a selectable range in a vertical direction.

9. An arrangement according to claim 8, in which said servomechanism is in the form of an electric motor.

10. An arrangement according to claim 8, in which said servomechanism is in the form of an adjusting piston that is disposed in a cylinder and is acted upon by a pressure medium.

11. An arrangement according to claim 3, which includes holding means disposed in said grass covering and/or in said insert means in the vicinity of said free spaces of said grass covering.

12. An arrangement according to claim 11, in which said holding means are in the form of a grid or wire insert.

13. An arrangement according to claim 11, in which said holding means are made of plastic.

14. An arrangement according to claim 3, in which said insert means of said free spaces of said grass covering are each in the shape of a planting pot and are supported on said liners.

15. An arrangement according to claim 14, in which said insert means are made of a resiliently deformable material.

16. An arrangement according to claim 15, in which said material is selected from the group consisting of foam material and rubber.

17. An arrangement according to claim 14, in which said planting pot liners are adapted to be removed via a special member.

18. An arrangement according to claim 14, in which said planting pot liners are adapted to be removed via compressed air.

* * * * *